US008923715B2

(12) United States Patent
Itoyama et al.

(10) Patent No.: US 8,923,715 B2
(45) Date of Patent: Dec. 30, 2014

(54) IMAGE FORMING APPARATUS AND IMAGE FORMING METHOD

(75) Inventors: Motoyuki Itoyama, Osaka (JP); Kiyofumi Morimoto, Osaka (JP); Takeshi Ohkawa, Osaka (JP); Tomoki Minamikawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 210 days.

(21) Appl. No.: 13/079,157

(22) Filed: Apr. 4, 2011

(65) Prior Publication Data

US 2011/0255888 A1 Oct. 20, 2011

(30) Foreign Application Priority Data

Apr. 19, 2010 (JP) ..... 2010-096328

(51) Int. Cl.
*G03G 15/10* (2006.01)
*G03G 15/00* (2006.01)
*G03G 15/08* (2006.01)

(52) U.S. Cl.
CPC .... *G03G 15/556* (2013.01); *G03G 2215/00721* (2013.01); *G03G 15/0849* (2013.01); *G03G 15/0824* (2013.01); *G03G 15/0831* (2013.01); *G03G 15/553* (2013.01)
USPC ..... 399/62; 399/16; 399/30; 399/260

(58) Field of Classification Search
CPC ..... G03G 15/0824; G03G 15/0849; G03G 2215/00721
USPC ..... 399/16, 30, 63
See application file for complete search history.

(56) References Cited

U.S. PATENT DOCUMENTS

| | | | | |
|---|---|---|---|---|
| 5,550,615 | A * | 8/1996 | Szlucha | 399/62 |
| 5,745,822 | A * | 4/1998 | Nishimura et al. | 399/106 |
| 7,558,496 | B2 * | 7/2009 | Watanabe | 399/62 |
| 2003/0161643 | A1 * | 8/2003 | Uyama et al. | 399/27 |
| 2004/0057755 | A1 * | 3/2004 | Yamaguchi et al. | 399/256 |
| 2009/0232524 | A1 | 9/2009 | Takahashi et al. | |
| 2010/0272457 | A1 * | 10/2010 | Mabuchi | 399/49 |

FOREIGN PATENT DOCUMENTS

| | | | |
|---|---|---|---|
| JP | 2005-43510 | A | 2/2005 |
| JP | 2006-106194 | A | 4/2006 |
| WO | WO 2007/091507 | A1 | 8/2007 |

* cited by examiner

*Primary Examiner* — Benjamin Schmitt
(74) *Attorney, Agent, or Firm* — Birch, Stewart, Kolasch & Birch, LLP

(57) ABSTRACT

An image forming apparatus includes: a developing device having a developing vessel, a developing roller and a toner supply port; a toner supply device; a toner supply detecting sensor for detecting the toner concentration inside the developing vessel; a toner concentration controller for directing toner supply; a toner empty detector; and a sheet conveyance detecting sensor. The toner concentration controller has a toner supply device control function; and a toner supply stopping function of stopping toner supply when the last sheet of image printout being executed has passed by the predetermined position in the sheet conveyance path.

6 Claims, 15 Drawing Sheets

IMAGE FORMING APPARATUS AND IMAGE FORMING METHOD

This Nonprovisional application claims priority under 35 U.S.C. §119(a) on Patent Application No. 2010-096328 filed in Japan on 19 Apr. 2010, the entire contents of which are hereby incorporated by reference.

BACKGROUND OF THE INVENTION (1) Field of the Invention

The present invention relates to an image forming apparatus and an image forming method, in particular relating to an image forming apparatus such as an electrostatic copier, laser printer, facsimile machine or the like to perform image forming using toner based on electrophotography as well as to an image forming method, in which a developing device that uses a dual-component developer containing a toner and a magnetic carrier is used.

(2) Description of the Prior Art

Conventionally, image forming apparatuses based on electrophotography such as copiers, printers, facsimile machines and the like have been known. The image forming apparatus using electrophotography forms an image by forming an electrostatic latent image on the surface of a photoreceptor, e.g., photoreceptor drum, supplying toner to the photoreceptor drum from a developing device to develop the electrostatic latent image, transferring the toner image formed on photoreceptor drum by development to a sheet of paper etc., and fixing the toner image onto the sheet by means of a fixing device.

Recently, in the image forming apparatuses supporting full-color and/or high-quality images, a dual-component developer (which will be referred to hereinbelow simply as "developer"), which presents excellent charge performance stability, is often used.

This developer consists of a toner and a carrier, which are agitated in the developing device and frictionally rubbed with each other to thereby produce appropriately tribo-electrified toner.

The electrified toner in the developing device is supplied to a dual-component developer supporting member, e.g., the surface of a developing roller. The toner thus supplied to the developing roller is moved by electrostatic attraction to the electrostatic latent image formed on the photoreceptor drum. Hereby, a toner image based on the electrostatic latent image is formed on the photoreceptor drum.

Further, recently, image forming apparatuses are demanded to be made compact and operate at high speeds, hence it has become necessary to electrify the developer quickly and sufficiently and also convey the developer quickly and smoothly.

For this purpose, in order to disperse supplied toner promptly into the developer and provide the toner with an appropriate amount of charge, a circulating type developing device has been adopted in some image forming apparatuses. This circulating type developing device includes: a developer conveying passage in which the developer is circulatively conveyed; a screw auger (developer conveying member) for conveying the developer while agitating the developer in the developer conveying passage; a toner supply port for leading toner from a toner container into the developer conveying passage; and a toner concentration detecting sensor for detecting the toner concentration in the developer. In this arrangement, when the toner concentration in the developer is lower than a predetermined level, a toner supply command is given to the toner cartridge so that toner is supplied to the developer conveying passage and the supplied toner is conveyed whilst being agitated with the developer (see Patent Document 1).

Proposed as another conventional technology is an image forming apparatus, which includes an image density measuring means for measuring image density every pixel in an image formed of a plurality of pixels, and a developer consumption estimating means for estimating the amount of developer to be consumed in development of the image based on the measurements, and supplies the developer by means of a developer supplying means within the period of image forming (see Patent Document 2).

The developer supplying means of Patent Document 2 supplies the developer in such a manner that the amount of developer to be consumed for forming one page of image, which is estimated from part of the image, is supplied to the developing device within the period in which the page of image is being formed. As a result, it is possible to control and supply an appropriate amount of toner on the halfway of printing the page, hence suppress the excess and deficiency errors of the amount of toner.

The developer supplying means in Patent Document 2 is adapted to end or suspend developer supply to the developing device before the predetermined time when the developer agitating means stops agitating. This feature makes it possible to avoid the developer agitating means leaving the developer supplied to the developer agitating means, insufficiently agitated and stopping agitation, so that the developer will have been sufficiently agitated right after the start of next development.

Patent Document 1:

Japanese Patent Application Laid-open 2006-106194

Patent Document 2:

International Publication WO2007/091507

In the aforementioned circulating type developing device using a dual-component developer, if toner to be supplied from the toner cartridge to the developing device is used up, the toner concentration in the developer gradually decreases and the carrier phenomena (carrier adherence) to the photoreceptor drum will occur more frequently, it is hence necessary to perform toner empty detection.

Toner empty detection is to determine (detect) the occurrence of a toner empty state when, for example, the toner concentration of the developer in the developing device, detected by the toner supply detecting sensor does not increase even after a toner supply command was given to the toner cartridge.

However, in the technology described in Patent Document 1, in the case where no toner is supplied even after a toner supply command was given to the toner cartridge because of toner empty in the toner cartridge, if the toner concentration detecting sensor is located away from the toner supply port through which toner is supplied, detection of toner empty is delayed because the fall of toner concentration detected by the toner concentration detecting sensor is sluggish. As a result, there occurs the problem that the occurrence of carrier adherence becomes more frequent.

On the other hand, Patent Document 2 discloses the above-described technology for suppressing variation in toner concentration in the developing device to as low as possible, but there is no description about the toner empty detection.

SUMMARY OF THE INVENTION

The present invention has been devised in view of the above problems, it is therefore an object of the present invention to provide an image forming apparatus and an image forming method, by which toner empty can be detected with precision by performing sampling for toner supply detection at the best timing, and occurrence of carrier adherence to the photoreceptor resulting from reduction in toner concentration can be suppressed.

The image forming apparatus and image forming method according to the present invention for solving the above problems are configured as follows:

The first aspect of the present invention resides in an image forming apparatus comprising: a developing device; a toner supply device that supplies toner to the developing device; a toner supply detecting sensor that detects the toner supply to the developing device; a toner concentration controller that directs the toner supply device to perform toner supply to the developing device when the toner concentration of a developer in the developing device becomes lower than a predetermined level; a toner empty determiner for determining that no toner is left in the toner supply device when the toner supply detecting sensor does not detect the effect of toner supply after the direction of the toner supply from the toner concentration controller; and, a paper conveyance detecting sensor for detecting the paper that passes by a predetermined position in the paper conveyance path through which paper is conveyed, and is characterized in that the developing device comprises: a developer container for storing a developer including the toner and a magnetic carrier; a developer conveying structure disposed inside the developer container for agitating and circulatively conveying the developer; a developing roller for supplying the toner contained in the developer to a photoreceptor drum; and, a toner supply port that leads the supplied toner into the developer container, and, the toner concentration controller has a function of controlling the operation of the toner supply device during a toner supply operation-permitted period; and a function of stopping the toner supply when the sheet conveyance detecting sensor detects that the last sheet of the image printing being executed, or the last sheet of the job being executed, has passed by the predetermined position in the sheet conveyance path.

The second aspect of the present invention is characterized in that the toner supply operation-permitted period is specified as the duration from time when a command of toner supply to the developing device is given from the toner concentration controller to the toner supply device, to time when it is determined by the sheet conveyance detecting sensor that the last sheet has passed thereby.

According to the third aspect of the present invention, it is preferable that the toner supply detecting sensor detects the magnetic permeability of the developer in the developer container.

The fourth aspect of the present invention is characterized in that the developer container includes a first conveying passage and a second conveying passage that are sectioned by a partitioning wall and arranged to communicate with each other at both ends of the partitioning wall, the developer conveying structure includes a first conveying member and a second conveying member that are arranged in the first convening passage and second conveying passage, respectively, agitate and circulatively convey the developer in the first conveying passage and in the second conveying passage, in opposite directions to each other, the developing roller supplies the developer inside the second conveying passage to the photoreceptor drum, the toner supply port is disposed over the first conveying passage, and, the toner supply detecting sensor is disposed at the bottom of the first conveying passage under the toner supply port.

The fifth aspect of the present invention is characterized in that the first conveying member is a screw auger having a rotary shaft and a helical blade, and the helical blade is formed so that the inclined angle relative to the axial direction of the rotary shaft is specified to fall within the range of 30 degrees to 60 degrees.

The image forming apparatus according to the sixth aspect of the present invention further includes a dot counter for counting dots of data corresponding to image data to be transmitted to the exposure device (e.g., laser scanner unit) for forming an electrostatic latent image on the photoreceptor drum surface, and is characterized in that the toner concentration controller instructs the toner supply device to supply toner to the developing device based on the count of the dots of data from the dot counter.

For example, when the number of dots of data counted by the dot counter is small, the toner concentration controller may direct the toner supply device to supply a small amount of toner to the developing device. When a large number of dots of data are counted, the controller may direct the toner supply device to supply a large amount of toner to the developing device. It is preferable that the amount of toner to be supplied has been specified in advance in accordance with the dot data.

For example, the technique of detecting the amount of toner supply by the toner supply detecting sensor disposed near the toner supply port is as follows:—

The average value of the output from the toner supply detecting sensor over one cycle of the helical blade is sampled for a fixed period of time immediately after the start of the supplying operation of the toner supply device. The difference between the maximum and minimum values (which will be referred to hereinbelow as "ΔTCS") may be calculated.

Further, the toner concentration controller may perform control so as to continue the permitted period of toner supply operation until the output from the paper conveyance detecting sensor located at a certain position in the paper conveyance path indicates the passage of the last printing paper being conveyed.

Moreover, the toner empty detector may record the ΔTCS for each toner supply operation, calculate the moving average of the latest M ΔTCS values, and determine that the amount of toner supply has reached a sufficiently low level and hence the toner supply device is empty of toner.

The seventh aspect of the present invention resides in an image forming method for an image forming apparatus comprising: a developer conveying step of agitating and circulatively conveying a developer containing a toner and a magnetic carrier inside a developing device; a developing step of supplying the toner from the developing device to a photoreceptor drum to develop an electrostatic latent image on the photoreceptor drum; a toner supplying step of supplying toner from a toner supply device to the developing device; a toner supply detecting step of detecting the toner supply into the developing device; a toner concentration control step of directing the toner supply device to perform the toner supply to the developing device; a toner empty detecting step of determining that the toner in the toner supply device is used up; and, a paper conveyance detecting step of detecting the paper passing by a predetermined position in the paper conveyance path for conveying paper, and is characterized in that the toner concentration control step includes the steps of: controlling the operation of the toner supply device during a toner supply operation-permitted period; and, stopping the toner supply at a timing when the fact that the last sheet of the image printing being executed has passed by the predetermined position in the sheet conveyance path the sheet conveyance detecting step is detected by the paper conveyance detecting step.

According to the eighth aspect of the present invention, it is preferred that the image forming apparatus described in any of the above first to sixth aspects is employed as the image forming apparatus.

According to the first aspect of the present invention, since it is possible to perform sampling for toner supply detection at the best timing, it is possible to correctly detect the status of toner empty without erroneous detection when the toner of the toner supply device has been used up. As a result, it is possible to prevent occurrence of carrier adherence resulting from reduction in toner concentration.

According to the second aspect of the present invention, it is possible to perform sampling of toner supply detection at the best timing.

According to the third aspect of the present invention, it is possible to easily detect the effect of toner supply by detecting change in toner concentration.

According to the fourth aspect of the present invention, the effect of toner supply can be detected with precision. Specifically, since the pressure on the developer becomes maximum at the bottom of the first conveying passage, voids are unlikely to form inside the developer. Accordingly it is possible to precisely detect the effect of toner supply with the toner supply detecting sensor.

According to the fifth aspect of the present invention, since the force of agitating the developer in the rotational direction of the first conveying member can be enhanced so that floating toner, or the supplied toner being conveyed floating over the developer, is unlikely to occur, it is possible for the toner supply detecting sensor to precisely detect the effect of toner supply.

According to the sixth aspect of the present invention, since it is possible to perform toner supply in a more exact manner compared to toner concentration control based on the toner concentration detected by the toner concentration detecting sensor, it is possible to perform toner concentration control and detection of toner empty, in a more precise manner.

Further, since the average value of the output from the toner supply detecting sensor over, for example one cycle of the helical blade is sampled for a fixed period of time immediately after the start of the supplying operation of the toner supply device, and the difference between the maximum and minimum values is calculated, it is possible to obtain a correct difference between the toner supply sensor outputs before and after a toner supply when the toner concentration controller performs control so as to continue the permitted period of toner supply operation until the output from the paper conveyance detecting sensor located at a certain position in the paper conveyance path indicates the passage of the last printing paper being conveyed. As a result it is possible to determine the status of toner empty without erroneous detection.

According to the seventh aspect of the present invention, since it is possible to perform sampling for toner supply detection at the best timing, it is possible to correctly detect the status of toner empty without erroneous detection when the toner of the toner supply device has been used up. As a result, it is possible to prevent occurrence of carrier adherence resulting from reduction in toner concentration.

According to the eighth aspect of the present invention, since toner empty can be precisely detected without making erroneous detection, it is possible to prevent occurrence of carrier adherence resulting from reduction in toner concentration, hence realize highly qualified image printout.

DESCRIPTION OF THE PREFERRED EMBODIMENTS

Now, the embodied mode for carrying out the present invention will be described with reference to the drawings.

Figure 1:
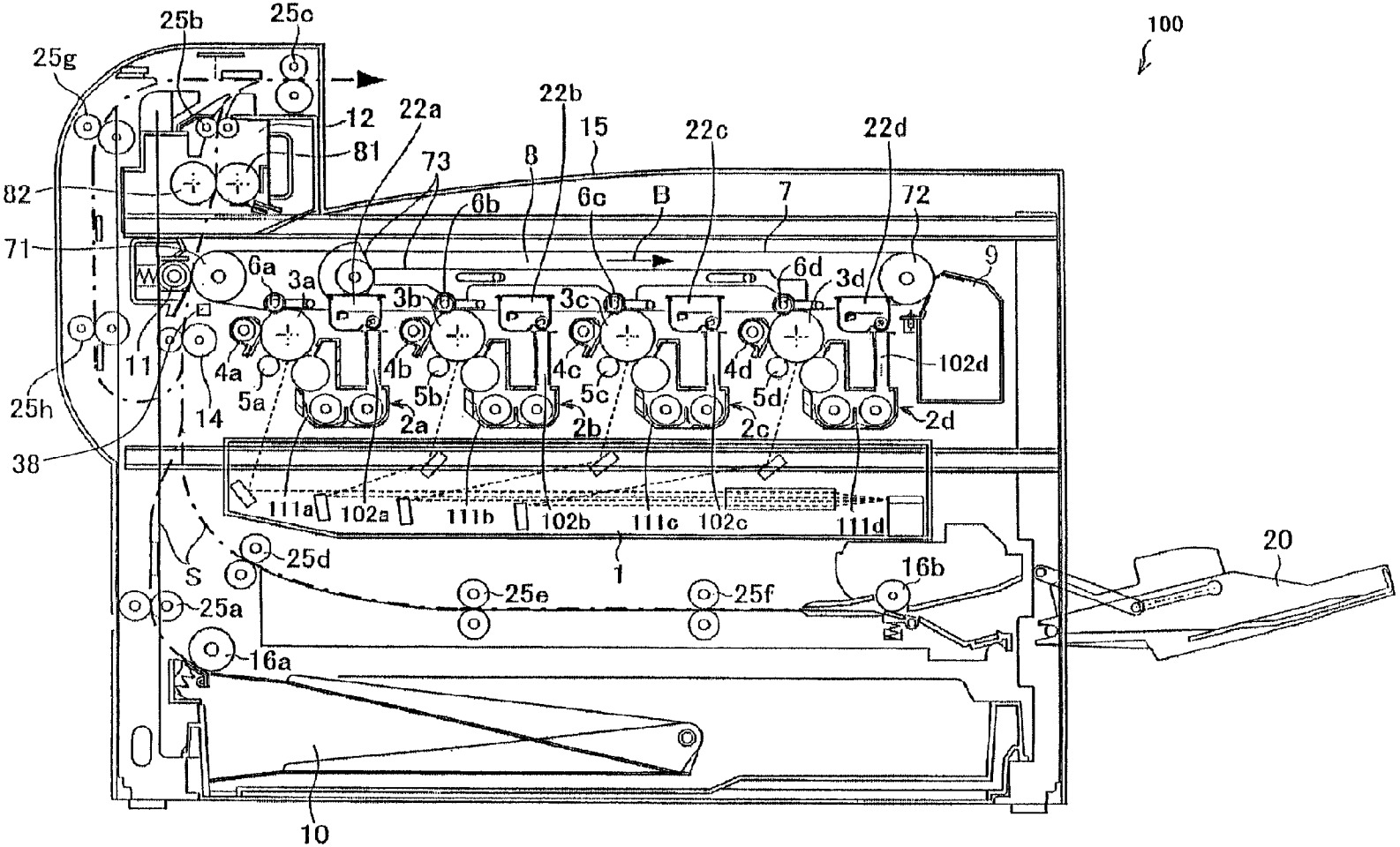
FIG. 1 is an illustrative view showing the overall configuration of an image forming apparatus according to the embodiment of the present invention.

FIG. 1 shows one exemplary embodiment of the present invention, and is an illustrative view showing the overall configuration of an image forming apparatus 100 according to the embodiment of the present invention.

Image forming apparatus 100 of the present embodiment forms an image with toners based on electrophotography, including: as shown in FIG. 1, photoreceptor drums 3*a*, 3*b*, 3*c* and 3*d* (which may also be called "photoreceptor drums 3" when general mention is made) for forming electrostatic latent images on the surfaces thereof; chargers (charging devices) 5*a*, 5*b*, 5*c* and 5*d* (which may also be called "chargers 5" when general mention is made) for charging the surfaces of photoreceptor drums 3; an exposure unit (exposure device) 1 for forming electrostatic latent images on the photoreceptor drum 3 surfaces; developing devices 2*a*, 2*b*, 2*c* and 2*d* (which may also be called "developing devices 2" when general mention is made) for supplying toners to the electrostatic latent images on the photoreceptor drum 3 surfaces to form toner images; toner supply devices 22*a*, 22*b*, 22*c* and 22*d* (which may also be called "toner supply devices 22" when general mention is made) for supplying toners to developing devices 2; an intermediate transfer belt unit (transfer device) 8 for transferring the toner images from the photoreceptor drum 3 surfaces to a recording medium; and a fixing unit (fixing device) 12 for fixing the toner image to the recording medium.

This image forming apparatus 100 forms a multi-color or monochrome image on a predetermined sheet (recording paper, recording medium) in accordance with image data transmitted from the outside. Here, image forming apparatus 100 may also include a scanner or the like on the top thereof.

To begin with, the overall configuration of image forming apparatus 100 will be described.

As shown in FIG. 1, image forming apparatus 100 separately handles image data of individual color components, i.e., black (K), cyan (C), magenta (M) and yellow (Y), and forms black, cyan, magenta and yellow images, superimposing these images of different color components to produce a full-color image.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four chargers 5 (5*a*, 5*b*, 5*c* and 5*d*) and four cleaner units 4 (4*a*, 4*b*, 4*c* and 4*d*) to form images of four different colors. In other words, four image forming stations (image forming portions) each including one developing device 2, one photoreceptor drum 3, one charger 5 and one cleaner unit 4 are provided.

Here, the symbols a to d are used so that 'a' represents the components for forming black images, 'b' the components for forming cyan images, 'c' the components for forming magenta images and 'd' the components for forming yellow images. Image forming apparatus 100 includes exposure unit 1, fixing unit 12, a sheet conveyor system (paper conveyance path) S and a paper feed tray 10 and a paper output tray 15.

Charger 5 is a device that uniformly electrifies the photoreceptor drum 3 surface at a predetermined potential.

As charger 5, other than the contact roller-type charger shown in FIG. 1, a contact brush-type charger, a non-contact type discharging type charger and others may be used.

Exposure unit 1 is a laser scanning unit (LSU) including a laser emitter and reflection mirrors as shown in FIG. 1. Other than the laser scanning unit, arrays of light emitting elements such as EL (electroluminescence) and LED writing heads, may be also used as exposure unit 1. Exposure unit 1 illuminates the photoreceptor drums 3 that have been electrified, with light in accordance with input image data so as to form electrostatic latent images corresponding to the image data on the surfaces of photoreceptor drums 3.

Developing device 2 is a device that visualize (develop) the electrostatic latent image formed on photoreceptor drum 3 with toner of K, C, M or Y. Arranged over developing devices 2 (2*a*, 2*b*, 2*c* and 2*d*) are toner transport mechanisms 102 (102*a*, 102*b*, 102*c* and 102*d*), toner supply devices 22 (22*a*, 22*b*, 22*c* and 22*d*) and developing vessels (developer containers) 111(111*a*, 111*b*, 111*c* and 111*d*).

Toner supply device 22 is arranged on the upper side of developing vessel 111 and stores unused toner (powdery toner). The toner is supplied from toner supply device 22 to developing vessel 111 by means of toner transport mechanism 102.

Cleaner unit 4 is a device that removes and collects the toner remaining on the photoreceptor drum 3 surface after development and image transfer steps.

Arranged over photoreceptor drums 3 is an intermediate transfer belt unit 8. Intermediate transfer belt unit 8 includes intermediate transfer rollers 6 (6*a*, 6*b*, 6*c* and 6*d*), an intermediate transfer belt 7, an intermediate transfer belt drive roller 71, an intermediate transfer belt driven roller 72, an intermediate transfer belt tensioning mechanism 73 and an intermediate transfer belt cleaning unit 9.

Intermediate transfer rollers 6, intermediate transfer belt drive roller 71, intermediate transfer belt driven roller 72 and intermediate transfer belt tensioning mechanism 73 support and tension intermediate transfer belt 7 to circulatively drive intermediate transfer belt 7 in the direction of an arrow B in FIG. 1.

Intermediate transfer rollers 6 are rotatably supported at intermediate transfer roller fitting portions in intermediate transfer belt tensioning mechanism 73. Applied to each intermediate transfer roller 6 is a transfer bias for transferring the toner image from photoreceptor drum 3 to intermediate transfer belt 7.

Intermediate transfer belt 7 is arranged so as to be in contact with each photoreceptor drum 3. The toner images of different color components formed on photoreceptor drums 3 are successively transferred one over another to intermediate transfer belt 7 so as to form a full-color toner image (multi-color toner image). This intermediate transfer belt 7 is formed of an endless film of about 100 to 150 μm thick, for instance.

Transfer of the toner image from photoreceptor drum 3 to intermediate transfer belt 7 is effected by intermediate transfer roller 6 which is put in contact with the interior side of intermediate transfer belt 7. A high-voltage transfer bias (high voltage of a polarity (+) opposite to the polarity (−) of the electrostatic charge on the toner) is applied to each intermediate transfer roller 6 in order to transfer the toner image.

Intermediate transfer roller 6 is composed of a base shaft formed of metal (e.g., stainless steel) having a diameter of 8 to 10 mm and a conductive elastic material (e.g., EPDM, foamed urethane, etc.) coated on the shaft surface. Use of this conductive elastic material enables intermediate transfer roller 6 to uniformly apply high voltage to intermediate transfer belt 7. Though in the present embodiment, roller-shaped elements (intermediate transfer rollers 6) are used as the transfer electrodes, brushes etc. can also be used in place.

The electrostatic latent image formed on each of photoreceptor drums 3 is developed as described above with the toner associated with its color component into a visual toner image. These toner images are laminated on intermediate transfer belt 7, laying one image over another. The thus formed lamination of toner images is conveyed by rotation of intermediate transfer belt 7 to the contact position (transfer position) between the conveyed paper and intermediate transfer belt 7, and is transferred to the paper by a transfer roller 11 arranged at that position. In this case, intermediate transfer belt 7 and transfer roller 11 are pressed against each other forming a predetermined nip while a voltage for transferring the toner image to the paper is applied to transfer roller 11. This voltage is a high voltage of a polarity (+) opposite to the polarity (−) of the electrostatic charge on the toner.

In order to keep the aforementioned nip constant, either transfer roller 11 or intermediate transfer belt drive roller 71 is formed of a hard material such as metal or the like while the other is formed of a soft material such as an elastic roller or the like (elastic rubber roller, foamed resin roller etc.).

Of the toner adhering to intermediate transfer belt 7 as the belt comes into contact with photoreceptor drums 3, the toner which has not been transferred from intermediate transfer belt 7 to the paper during transfer of the toner image and remains on intermediate transfer belt 7 would cause contamination of colors at the next operation, hence is removed and collected by intermediate transfer belt cleaning unit 9.

Intermediate transfer belt cleaning unit 9 includes a cleaning blade (cleaning member) that is put in contact with intermediate transfer belt 7. Intermediate transfer belt 7 is supported from its interior side by intermediate transfer belt driven roller 72, at the area where this cleaning blade is put in contact with intermediate transfer belt 7.

Paper feed tray 10 is to stack sheets (e.g., recording paper) to be used for image forming and is disposed under the image forming portion and exposure unit 1. On the other hand, paper output tray 15 disposed at the top of image forming apparatus 100 stacks printed sheets facedown.

Image forming apparatus 100 also includes sheet conveyor system S for guiding sheets from paper feed tray 10 and from a manual feed tray 20 to paper output tray 15 by way of the transfer portion and fixing unit 12. Here, the transfer portion is located between intermediate transfer belt drive roller 71 and transfer roller 11.

Arranged along sheet conveyor system S are pickup rollers 16 (16*a*, 16*b*), a registration roller 14, the transfer portion, fixing unit 12 and feed rollers 25 (25*a* to 25*h*) and the like.

Feed rollers 25 are a plurality of small-diametric rollers arranged along sheet conveyor system S to promote and assist sheet conveyance. Pickup roller 16*a* is a roller disposed at the end of paper feed tray 10 for picking up and supplying the paper one sheet at a time from paper feed tray 10 to sheet conveyor system S. Pickup roller 16*b* is a roller disposed at the vicinity of manual feed tray 20 for picking up and supplying the paper, one sheet at a time, from manual feed tray 20 to sheet conveyor system S. Registration roller 14 temporarily suspends the sheet being conveyed on sheet conveyor system S and delivers the sheet to the transfer portion at such timing that the front end of the sheet meets the front end of the toner image on intermediate transfer belt 7.

Fixing unit 12 includes a heat roller 81, a pressing roller 82 and the like. These heat roller 81 and pressing roller 82 rotate while nipping the sheet therebetween. Heat roller 81 is controlled by a control unit 32 (FIG. 8) so as to keep a predetermined fixing temperature. This control unit 32 controls the temperature of heat roller 81 based on the detection signal from a temperature detector (not shown).

Heat roller 81 thermally presses the sheet in cooperation with pressing roller 82, and fuses, mixes and presses the lamination of individual color toner images transferred on the sheet, to thereby thermally fix the toner onto the sheet. The sheet with a multi-color toner image (an individual color toner image) fixed thereon is conveyed by plural feed rollers 25 to the inversion paper discharge path of sheet conveyor system S and discharged onto paper output tray 15 in an inverted position (with the multi-color toner image placed facedown).

Next, the operation of sheet conveyance by sheet conveyor system S will be described.

As shown in FIG. 1, image forming apparatus 100 has paper feed tray 10 that stacks sheets beforehand and manual feed tray 20 that is used when a few pages are printed out. Each tray is provided with pickup roller 16 (16*a*, 16*b*) so that these pickup rollers 16 supply the paper one sheet at a time to sheet conveyor system S.

In the case of one-sided printing, the sheet conveyed from paper feed tray 10 is conveyed by feed roller 25*a* in sheet conveyor system S to registration roller 14 and delivered to the transfer portion (the contact position between transfer roller 11 and intermediate transfer belt 7) by registration roller 14 at such timing that the front end of the sheet meets the front end of the image area including a lamination of toner images on intermediate transfer belt 7. At the transfer portion, the toner image is transferred onto the sheet. Then, this toner image is fixed onto the sheet by fixing unit 12. Thereafter, the sheet passes through a feed roller 25*b* to be discharged by a paper output roller 25*c* onto paper output tray 15.

Also, the sheet conveyed from manual feed tray 20 is conveyed by plural feed rollers 25 (25*f*, 25*e* and 25*d*) to registration roller 14. From this point, the sheet is conveyed and discharged to paper output tray 15 through the same path as that of the sheet fed from the aforementioned paper feed tray 10.

On the other hand, in the case of dual-sided printing, the sheet having been printed on the first side and passed through fixing unit 12 as described above is nipped at its rear end by paper discharge roller 25*c*. Then the paper discharge roller 25*c* is rotated in reverse so that the sheet is guided to feed rollers 25*g* and 25*h*, and conveyed again through registration roller 14 so that the sheet is printed on its rear side and then discharged to paper output tray 15.

Next, the configuration of toner supply device 22 will be specifically described.

Figure 2:
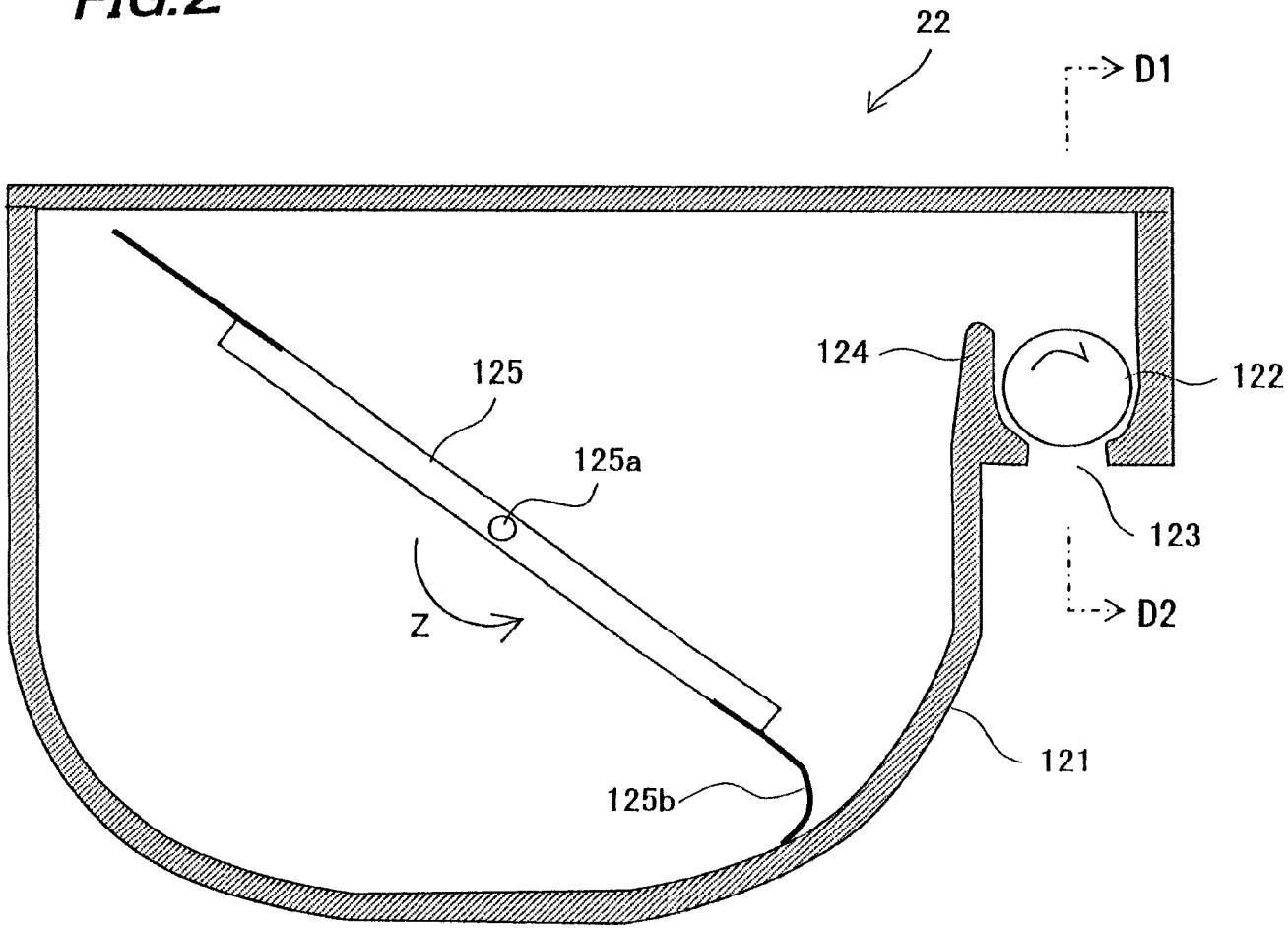
FIG. 2 is a sectional view showing a schematic configuration of a toner supply device that constitutes the image forming apparatus.
Figure 3:
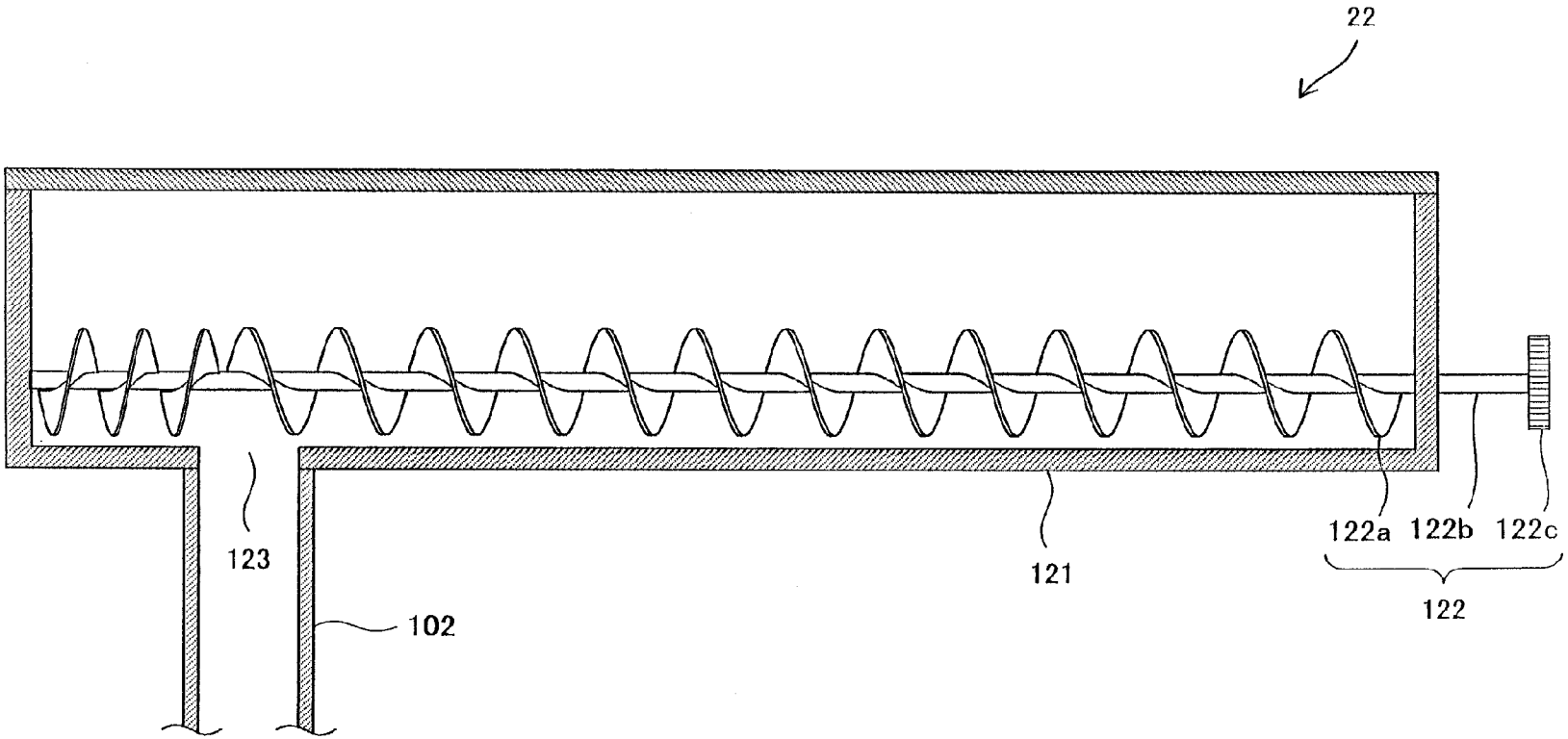
FIG. 3 is a sectional view cut along a plane D1-D2 in FIG. 2.

FIG. 2 is a sectional view showing a schematic configuration of the toner supply device that constitutes the image forming apparatus according to the present embodiment. FIG. 3 is a sectional view cut along a plane D1-D2 in FIG. 2.

As shown in FIG. 2, toner supply device 22 includes a toner storing container 121, a toner agitator 125, a toner discharger 122 and a toner discharge port 123. Toner supply device 22 is arranged on the upper side of developing vessel 111 (FIG. 1) and stores unused toner (powdery toner). The toner in toner supply device 22 is supplied from toner discharge port 123 to developing vessel 111 by way of toner transport mechanism 102 (FIG. 1) as toner discharger (discharging screw) 122 is rotated.

Toner storing container 121 is a container part that has a substantially semicylindrical configuration with a hollow interior, supports toner agitator 125 and toner discharger 122 in a rotatable manner and stores toner. As shown in FIG. 3, toner discharge port 123 is a substantially rectangular opening disposed under toner discharger 122 and positioned near to the center with respect to the direction of the axis (the axial direction: longitudinal direction) of toner discharger 122 so as to oppose toner transport mechanism 102.

Toner agitator 125 is a plate-like part that rotates about a rotary axis 125*a* as shown in FIG. 2 and draws up and conveys the toner stored inside toner storing container 121 toward toner discharger 122 whilst agitating the toner. Toner agitator 125 has toner scooping parts 125*b* at both the ends thereof. Toner scooping part 125*b* is formed of a polyethylene terephthalate (PET) sheet having flexibility and is attached to either end of toner agitator 125.

Figure 8:
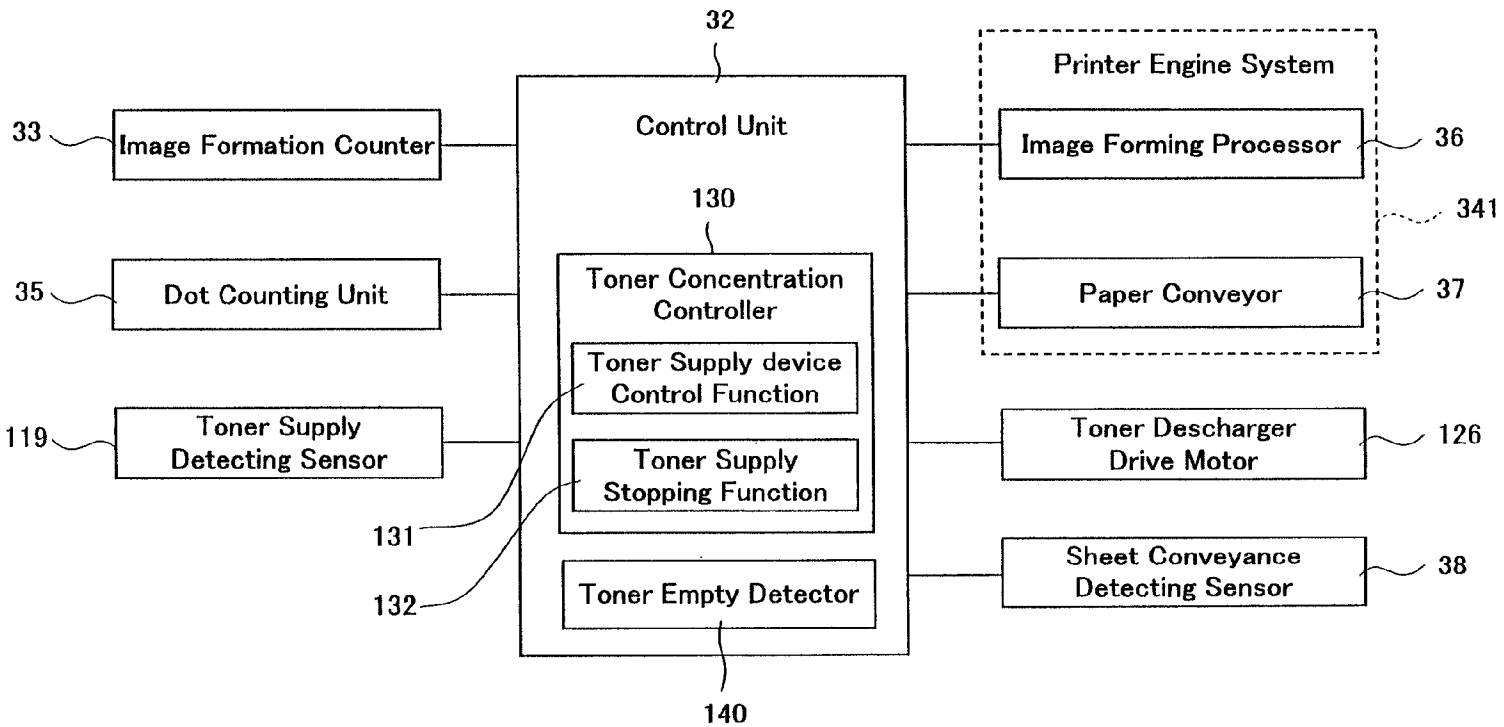
FIG. 8 is a block diagram showing a control system configuration in the image forming apparatus.

Toner discharger 122 dispenses the toner in toner storing container 121 from toner discharge port 123 to developing vessel 111, and is formed of a screw auger having a toner conveyor blade 122*a* and a toner discharger rotary shaft 122*b* and a toner discharger rotating gear 122*c*, as shown in FIG. 3. Toner discharger 122 is rotationally driven by a toner discharger drive motor 126 (FIG. 8). As to the helix direction of the screw auger, the blade is formed so that toner can be conveyed from both ends of toner discharger 122 toward toner discharge port 123.

Provided between toner discharger 122 and toner agitator 125 is a toner discharger partitioning wall 124. This wall makes it possible to keep and hold the toner scooped by toner agitator 125 in an appropriate amount around toner discharger 122.

As shown in FIG. 2, when toner agitator 125 rotates in the direction of arrow Z to agitate and scoop up the toner toward toner agitator 122, toner scooping parts 125*b* rotate as they are deforming and sliding over the interior wall of toner storing container 121 due to the flexibility thereof, to thereby supply the toner toward the toner discharger 122 side. Then, toner discharger 122 turns so as to lead the supplied toner to toner discharge port 123.

Next, the configuration of image forming apparatus 100 will be described with reference to the drawings.

Figure 4:
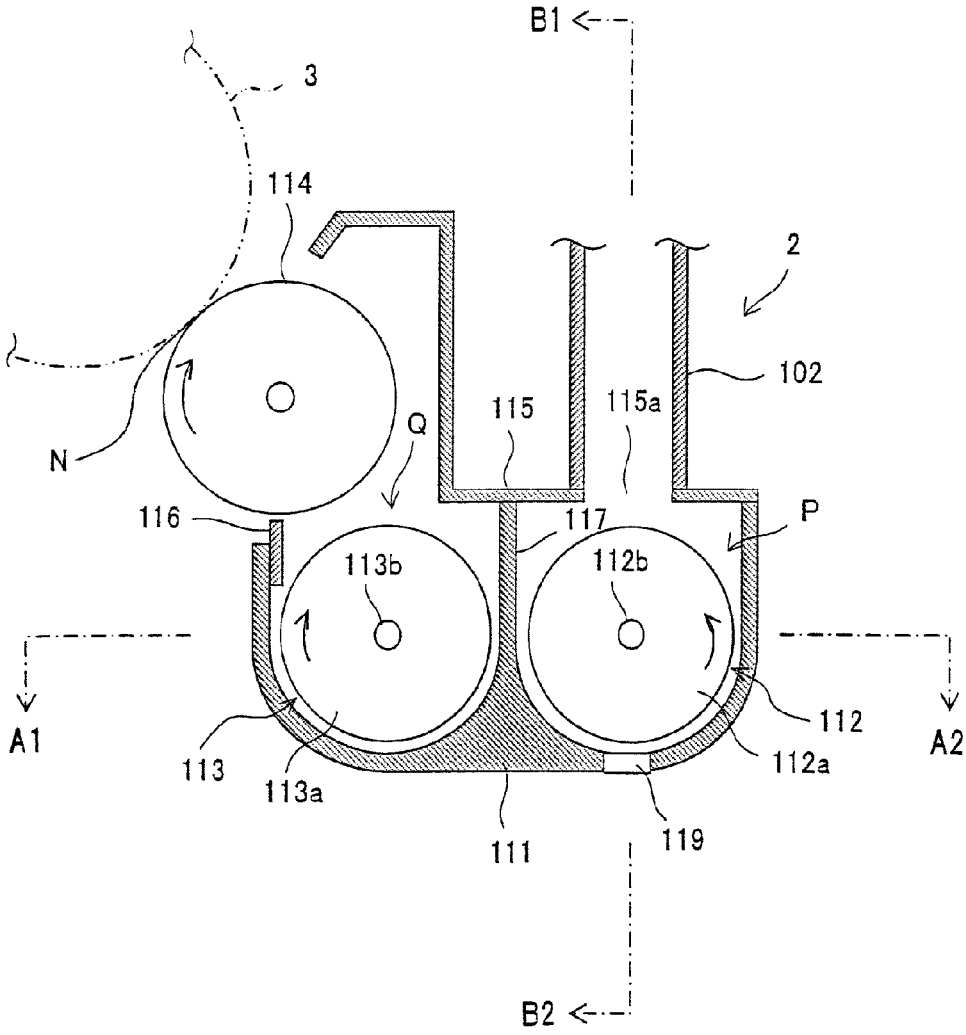
FIG. 4 is a sectional view showing a configuration of a developing device that constitutes the image forming apparatus.
Figure 5:
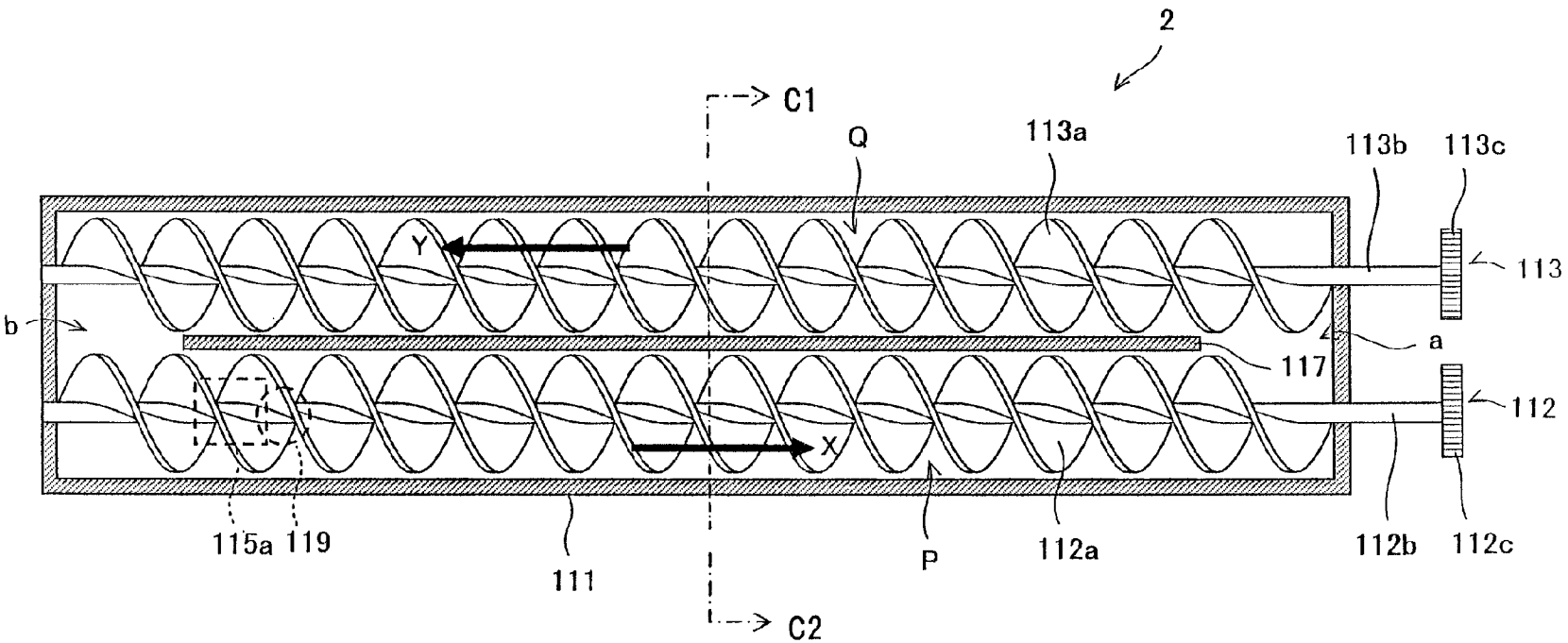
FIG. 5 is a sectional view cut along a plane A1-A2 in FIG. 4.
Figure 6:
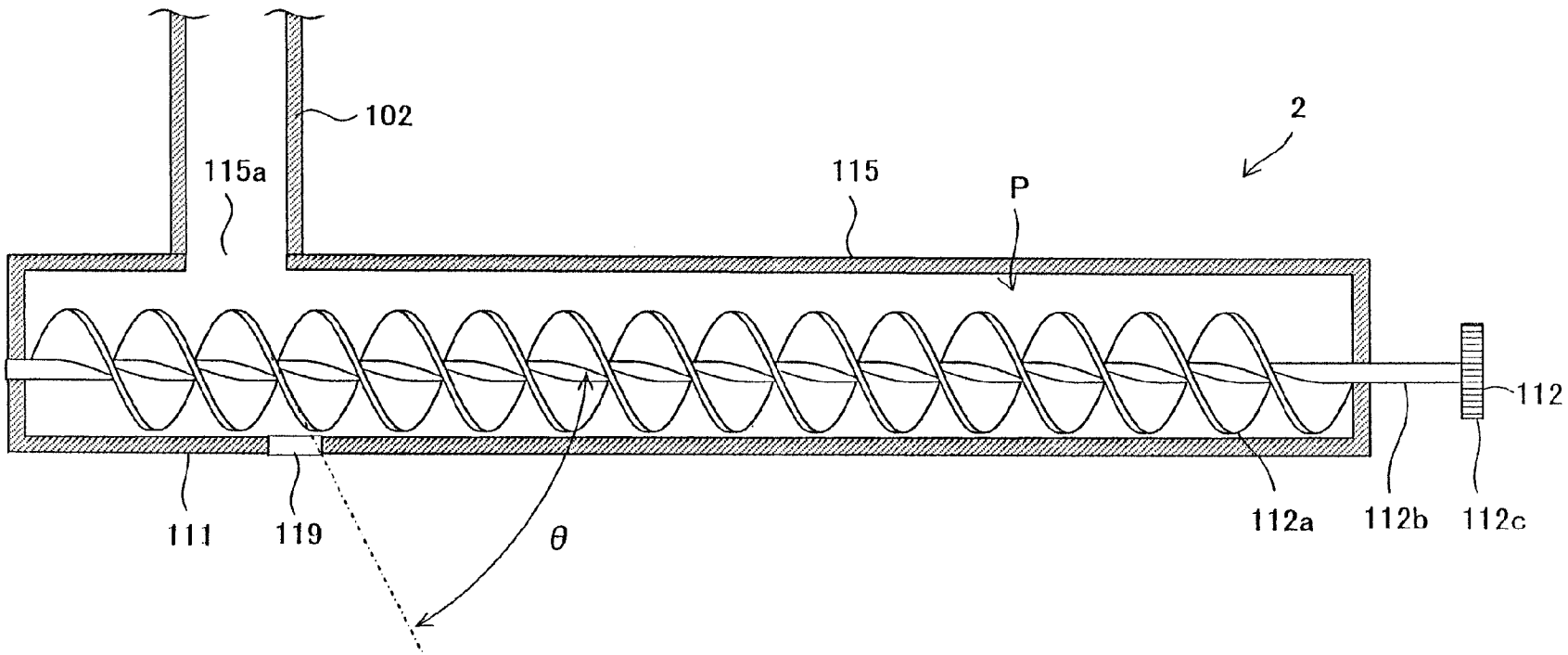
FIG. 6 is a sectional view cut along a plane B1-B2 in FIG. 4.
Figure 7:
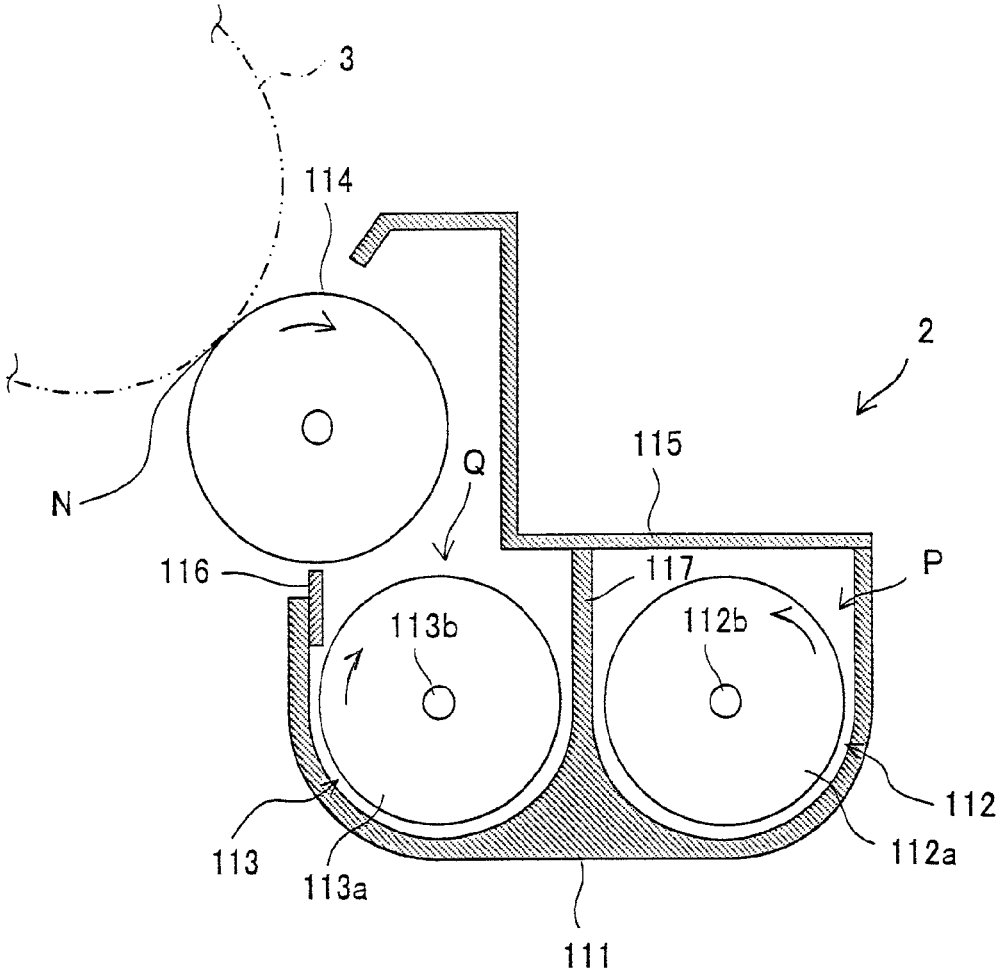
FIG. 7 is a sectional view cut along a plane C1-C2 in FIG. 5.

FIG. 4 is a sectional view showing the configuration of a developing device that constitutes the image forming apparatus according to the present embodiment, FIG. 5 is a sectional view cut along a plane A1-A2 in FIG. 4, FIG. 6 is a sectional view cut along a plane B1-B2 in FIG. 4, and FIG. 7 is a sectional view cut along a plane C1-C2 in FIG. 5.

Image forming apparatus 100 of the present embodiment includes: as shown in FIG. 4, developing device 2 having a toner supply port 115*a* through which supplied toner is input into developing vessel (developer container) 111 holding the developer; toner supply device 22 for supplying toner to developing device 2; a toner supply detecting sensor 119 for detecting whether toner is supplied into the developer container; a toner concentration controller 130 (see FIG. 8) that directs toner supply device 22 to supply toner to developing device 2 when the toner concentration of the developer in developing device 2 becomes lower than a predetermined level; and a toner empty detector 140 (see FIG. 8) for determining that toner supply device 22 is empty of toner when toner supply detecting sensor 119 could not detect any effect of toner supply after a toner supply command was given from toner concentration controller 130. Further, in image forming apparatus 100, toner supply detecting sensor 119 is arranged near toner supply port 115*a* inside developing vessel 111.

To begin with, developing device 2 will be described with reference to the drawings.

As shown in FIG. 4, developing device 2 is a device that includes a developing roller (developer bearer) 114 arranged inside developing vessel 111 so as to oppose photoreceptor drum 3 and visualizes (develops) the electrostatic latent image formed on the surface of photoreceptor drum 3, by supplying toner from developing roller 114 to the photoreceptor drum 3 surface.

Developing device 2 includes, other than developing roller 114, developing vessel 111, a developing vessel cover 115, toner supply port 115*a*, a doctor blade 116, a first conveying member 112, a second conveying member 113, a partitioning plate (partitioning wall) 117 and toner supply detecting sensor 119.

Developing vessel 111 is a receptacle for holding a dual-component developer that contains a toner and a carrier (which will be simply referred to hereinbelow as "developer"). Developing vessel 111 includes developing roller 114, first conveying member 112, second conveying member 113 and the like. Here, the carrier of the present embodiment is a magnetic carrier presenting magnetism.

Arranged on the top of developing vessel 111 is removable developing vessel cover 115, as shown in FIGS. 4 and 6. This developing vessel cover 115 is formed with toner supply port 115*a* for supplying unused toner into developing vessel 111.

Arranged between first conveying member 112 and second conveying member 113 in developing vessel 111 is partitioning plate 117, as shown in FIGS. 4 and 5. Partitioning plate 117 is extended parallel to the axial direction (the direction in which each rotary axis is laid) of first and second conveying members 112 and 113. The interior of developing vessel 111 is divided by partitioning plate 117 into two sections, namely, a first conveying passage P with first conveying member 112 therein and a second conveying passage Q with second conveying member 113 therein.

Partitioning plate 117 is arranged so that its ends, with respect to the axial direction of first and second conveying members 112 and 113, are spaced from respective interior wall surfaces of developing vessel 111 (FIG. 5). Hereby, developing vessel 111 is formed with communicating paths that establish communication between first conveying passage P and second conveying passage Q at around both axial ends of first and second conveying members 112 and 113. In the following description, as shown in FIG. 5 the communicating path in the direction of arrow X is named first communicating path a and the communicating path formed in the direction of arrow Y is named second communicating path b.

First conveying member 112 and second conveying member 113 are arranged so that their axes are parallel to each other with their peripheral sides opposing each other across partitioning plate 117, and are rotated in opposite directions. That is, as shown in FIG. 5, first conveying member 112 conveys the dual-component developer in the direction of arrow X while second conveying member 113 conveys the developer in the direction of arrow Y, which is the opposite to the direction of arrow X.

As shown in FIG. 5, first conveying member 112 is composed of a screw auger formed of a first helical conveying blade 112*a* and a first rotary shaft 112*b*, and a gear 112*c*. As shown in FIG. 5, second conveying member 113 is composed of a screw auger formed of a second helical conveying blade 113*a* and a second rotary shaft 113*b*, and a gear 113*c*. First and second conveying members 112 and 113 are rotationally driven by an unillustrated drive means such as a motor or the like to agitate and convey the developer.

As shown in the sectional view of FIG. 6, first conveying member 112 is formed so that the angle formed between first rotary shaft 112*b* and the peripheral edge of first conveying blade 112*a*, or the inclined angle θ of the helical blade, falls within the range of 30 degrees to 60 degrees.

Specifically, when the inclined angle θ of the helical blade of first conveying member 112 is equal to or greater than 30 degrees and equal to or smaller than 60 degrees, the force of first conveying member 112 for agitating the developer in the rotational direction is so strong that the so-called "floating toner", the supplied toner being conveyed floating over the developer, is unlikely to occur. Accordingly, it is possible for toner supply detecting sensor 119 to detect the toner concentration of the developer with precision even after toner supply.

On the other hand, when the inclined angle θ of the helical blade is less than 30 degrees, the speed of the developer being conveyed by first conveying member 112 is low so that the developer is abraded quickly. When the inclined angle θ of the helical blade exceeds 60 degrees, the speed of the developer being conveyed by first conveying member 112 becomes so high that the floating toner is prone to occur.

Developing roller 114 (FIG. 4) is a magnet roller which is rotationally driven about its axis by an unillustrated driver, and draws up and carries the developer in developing vessel 111 on the surface thereof to supply toner included in the developer supported on the surface thereof to photoreceptor drum 3.

The developer conveyed by developing roller 114 comes in contact with photoreceptor drum 3 in the area where the surfaces of developing roller 114 and photoreceptor drum 3 becomes closest. This contact area is called a developing nip portion N (FIG. 4). Application of a developing bias to developing roller 114 from an unillustrated power source that is connected to developing roller 114 causes the toner in developing nip portion N to transfer from the developer on the developing roller 114 surface to the electrostatic latent image on the photoreceptor drum 3 surface.

Arranged close to the surface of developing roller 114 is a doctor blade (layer thickness limiting blade) 116.

Doctor blade 116 is a plate-shaped member that is extended parallel to the axial direction of developing roller 114, disposed vertically below developing roller 114 and supported along its longitudinal side by developing vessel 111 so that its opposite longitudinal side is spaced from the developing roller 114 surface. This doctor blade 116 may be made of stainless steel, or may be formed of aluminum, synthetic resin or the like.

Concerning the attachment of toner supply detecting sensor 119, with regard to the horizontal direction (developer conveying direction), the sensor is attached at a position near and on the downstream side of toner supply port 115*a* with respect to the developer conveying direction (the direction of arrow X) while with regard to the vertical direction, the sensor is attached on the base of developing vessel 111 vertically below first conveying member 112, as shown in FIGS. 4 to 6. That is, toner supply detecting sensor 119 is attached to the base of first conveying passage P with its sensor face exposed to the interior of developing vessel 111.

Toner supply detecting sensor 119 is electrically connected to toner concentration controller 130 (see FIG. 8). Toner supply detecting sensor 119 may use general-purpose detecting sensors. Examples include transmitted light detecting sensors, reflected light detecting sensors, magnetic permeability detecting sensors, etc. Of these, magnetic permeability detecting sensors are preferable.

The magnetic permeability detecting sensor is connected to an unillustrated power supply. This power supply applies to the magnetic permeability detecting sensor a drive voltage for driving the magnetic permeability detecting sensor and a control voltage for outputting the detected result of toner concentration to the control device. Application of voltage to the magnetic permeability detecting sensor from the power supply is controlled by the control device. The magnetic permeability detecting sensor is a sensor of a type that receives application of a control voltage and outputs the detected result of toner concentration as an output voltage. Basically, the sensor is sensitive in the middle range of the output voltage, so that the applied control voltage is adjusted so as to produce an output voltage around that range. Magnetic permeability detecting sensors of this kind are found on the market, examples including TS-L, TS-A and TS-K (all of these are trade names of products of TDK Corporation).

Now, conveyance of the developer in the developing vessel of developing device 2 will be described.

As shown in FIGS. 1 and 5, the toner stored in toner supply device 22 is transported into developing vessel 111 by way of toner transport mechanism 102 and toner supply port 115*a*, whereby toner is supplied to developing vessel 111.

In developing vessel 111, first conveying member 112 and second conveying member 113 are rotationally driven by an unillustrated drive means such as a motor or the like to convey the developer. More specifically, in first conveying passage P, the developer is agitated and conveyed in the direction of arrow X by first conveying member 112 to reach first communicating path a. The developer reaching first communicating path a is conveyed through first communicating path a to second conveying passage Q.

On the other hand, in second conveying passage Q, the developer is agitated and conveyed in the direction of arrow Y by second conveying member 113 to reach second communicating path b. Then, the developer reaching second communicating path b is conveyed through second communicating path b to first conveying passage P.

That is, first conveying member 112 and second conveying member 113 agitate the developer while conveying it in opposite directions.

In this way, the developer is circulatively moving in developing vessel 111 along first conveying passage P, first communicating path a, second conveying passage Q and second communicating path b, in this mentioning order. In this arrangement, the developer is carried and drawn up by the surface of rotating developing roller 114 while being conveyed in second conveying passage Q, and the toner in the drawn up developer is continuously consumed as transferring to photoreceptor drum 3.

In order to compensate for this consumption of toner, unused toner is supplied from toner supply port 115*a* to the first conveying passage P. The thus supplied toner is agitated and mixed in first conveying passage P with the previously existing developer.

Next, the configuration of the control system of image forming apparatus 100 will be described with reference to a block diagram.

Figure 9:
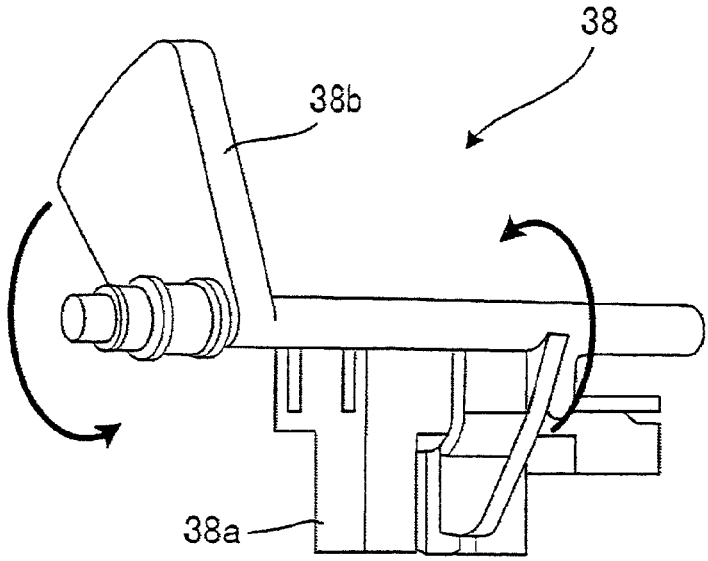
FIG. 9 is an illustrative view showing a configuration of a sheet conveyance detecting sensor that forms a control system of the image forming apparatus.

FIG. 8 is a block diagram showing a configuration of the control system in the image forming apparatus of the present embodiment. FIG. 9 is an illustrative view showing a configuration of a sheet conveyance detecting sensor that forms the control system of the image forming apparatus.

As shown in FIG. 8, image forming apparatus 100 includes an image formation counter 33 for counting the total number of image forming operations, a dot counting unit (dot counter) 35 for detecting the total count of pixels of an image formed on photoreceptor drum 3, toner supply detecting sensor 119 for detecting the magnetic permeability of the developer near the toner supply port, a printer engine system 341 including an image forming processor 36 and a paper conveyor 37, a sheet conveyance detecting sensor 38, a toner discharger drive motor 126 for driving toner discharger 122 (FIGS. 2 and 3) that supplies toner to developing vessel 111 and control unit 32 for controlling these.

Control unit 32 determines the amount of toner to be consumed for the current image forming based on the dot count value and directs toner discharger drive motor 126 to rotationally drive toner discharger 122 of toner supply device 22 (FIG. 2) in accordance with the determined amount of toner. Control unit 32 further includes toner concentration controller 130 and toner empty detector 140.

Now, toner concentration controller 130 and toner empty detector 140 will be described in a specific manner.

Toner concentration controller 130 may use a typical method, the examples including control using a toner concentration detecting sensor, control based on patch image density, control based on dot counting and the like. Of these, dot count control is preferable.

Toner concentration controller 130 is essentially associated with dot counting unit 35, a sheet conveyance detecting sensor 38 and toner discharger drive motor 126.

Toner concentration controller 130 further has a toner supply device control function 131 for controlling the operation of toner supply device 22 in its permitted period of toner supply operation; and a toner supply stopping function 132 for stopping toner supply when sheet conveyance detecting sensor 38 detects that the last sheet (paper) of the image printing being executed has passed by a predetermined position in the sheet conveyor system S.

Toner empty detector 140 is essentially associated with toner supply detecting sensor 119. Toner empty detector 140 is adapted to continuously monitor the toner concentration of the developer in developing vessel 111 through toner supply detecting sensor 119, and if toner supply detecting sensor 119 cannot detect any effect of toner supply even after a command of toner supply to developing device 2 was given to toner concentration controller 130, it is determined that no toner is supplied from toner supply device 22 to developing device 2 or that no toner remains in toner supply device 22 (toner empty).

Dot counting unit 35 is to detect the total number of pixels of images (electrostatic latent images) formed on photoreceptor drum 3 corresponding to the printed images, and transmits to control unit 32 the total count of the pixels of the images to be printed and the images that have been printed heretofore as a dot count value. Control unit 32 records the received dot count value. It is possible to estimate the amount of toner consumed for image forming, from the total count of pixels of images detected by dot counting unit 35.

Based on the estimated toner consumption, toner equivalent to the amount of toner having been consumed from developing device 2 (developing vessel 111) is supplied from toner supply device 22 to developing device 2 (developing vessel 111).

Toner conveyance detecting sensor 38 detects the sheet passing through sheet conveyor system S (FIG. 1). In the present embodiment, sheet conveyance detecting sensor 38 is disposed downstream of registration roller 14 with respect to the direction of sheet conveyance and around transfer roller 11 and intermediate transfer belt drive roller 71, in sheet conveyor system S.

Though in the present embodiment, sheet conveyance detecting sensor 38 is arranged on the upstream side of transfer roller 11 and intermediate transfer belt drive roller 71 with respect to the direction of sheet conveyance, the sensor may be disposed downstream of these with respect to the direction of sheet conveyance.

As shown in FIG. 9, sheet conveyance detecting sensor 38 includes a detector 38*a* of a photo interrupter and a detection piece 38*b* to be detected by detector 38*a*.

Detection piece 38*b* is rotatably attached so as to turn on and off detector 38*a* when the paper being conveyed abut the detection piece.

Next, toner supply to developing device 2 will be explained.

When the toner concentration of the developer in developing vessel 111 of developing device 2 has lowered and becomes lower than a predetermined level, a command for toner supply to developing device 2 is transmitted from toner concentration controller 130 to toner supply device 22 so that toner supply to developing device 2 in image forming apparatus 100 is performed from toner supply device 22 to developing device 2.

The effect of toner supply into developing vessel 111 is detected by toner supply detecting sensor 119. Since toner supply detecting sensor 119 is disposed on the base in the first conveying passage P under toner supply port 115*a* as shown in FIG. 4, if toner is supplied to the developer from toner supply port 115*a*, it is possible to promptly detect change of the magnetic permeability of the developer. That is, it is possible to immediately check whether or not toner supply from toner supply device 22 is performed.

Accordingly, when a command of toner supply was given from toner concentration controller 130 to toner supply device 22, if toner supply detecting sensor 119 does not detect any change of the magnetic permeability of the developer, it is possible to determine that no toner supply from toner supply device 22 has been made. That is, it is possible by toner empty detecting means 140 to immediately determine that the toner in toner supply device 22 is used up (toner empty).

Next, how image forming apparatus 100 of the present embodiment determines the status of toner empty based on the change in magnetic permeability before and after a toner supply will be specifically described with reference to the drawings.

Figure 10:
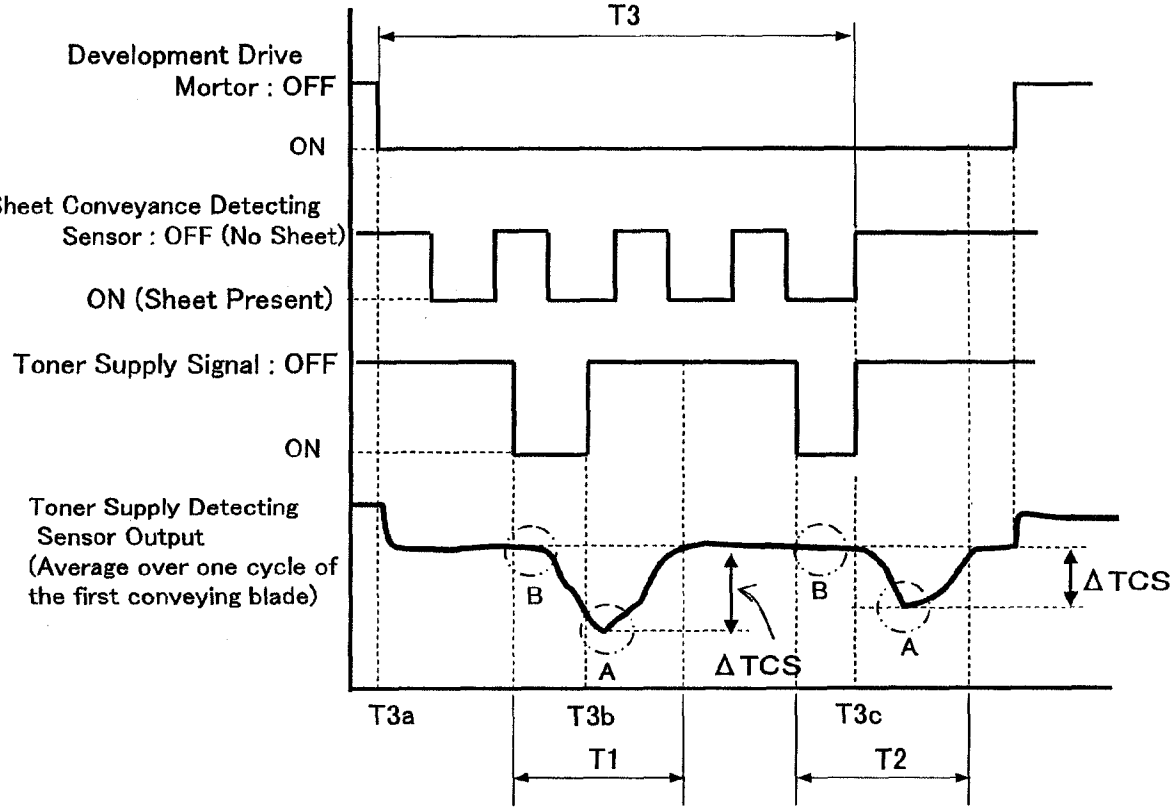
FIG. 10 is a graph showing a relationship between a toner supply signal indicating toner supply from a toner supply device and the output from a toner supply detecting sensor in the image forming apparatus.
Figure 11:
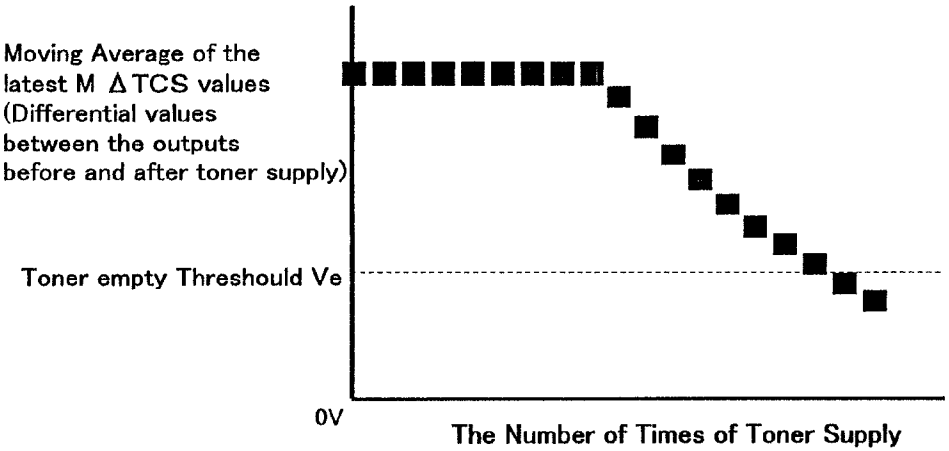
FIG. 11 is a graph showing a relationship between the difference between the output values from a toner supply detecting sensor before and after toner supply from the toner supply device and total toner supply time.

FIG. 10 is a graph showing a relationship between a toner supply signal indicating a toner supply from the toner supply device and the output from the toner supply detecting sensor in the image forming apparatus of the present embodiment. FIG. 11 is a graph showing a relationship between the difference between the output values from the toner supply detecting sensor before and after a toner supply from the toner supply device and total toner supply time.

When the sensor outputs from toner supply detecting sensor 119 before and after a toner supply are given as B and A, respectively, the output difference Δ(B−A) (which will be called "ΔTCS" hereinbelow) is calculated for each operation of toner supply, as shown in FIG. 10. Instead of difference Δ(B−A) in the output value from the toner supply detecting sensor, a ratio of the sensor output values before and after a toner supply (A/B or B/A) may also be used.

Specifically, in image forming apparatus 100, the output value from toner supply detecting sensor 119 is continuously monitored as the average over one cycle of helical conveying blade 112*a*, as shown in FIG. 10. Then, immediately after a command is given to toner discharger drive motor 126 (FIG. 8) so as to cause toner discharger 122 (FIGS. 2 and 3) of toner supply device 22 to rotate, the average output value from toner supply detecting sensor 119 is sampled for a predetermined period of time. In FIG. 10, T1 and T2 represents the sampling times for detecting toner concentration by toner supply detecting sensor 119.

From the maximum value B and the minimum value A of the sampling data, ΔTCS of toner supply detecting sensor 119 before and after a toner supply is calculated.

Then, every time toner discharger drive motor 126 starts operating, ΔTCS is calculated and stored, and the moving average of the latest M ΔTCS values is calculated.

Since toner supply from toner supply device 22 (FIG. 2) is stable with a large amount of toner falling when a sufficient amount of toner is left in toner supply device 22, as shown in FIG. 11, ΔTCS presents a large value. On the other hand, when the remaining amount of toner in toner supply device 22 is low, ΔTCS presents a small value, approaching to "0".

With the toner empty decision threshold given as Ve, when the moving average of M ΔTCS values becomes lower than toner empty decision threshold Ve, it is determined that the amount of remaining toner has become sufficiently low and hence the toner supply device is empty of toner.

In the present embodiment, the average of the output values from toner supply detecting sensor 119 over one cycle of helical conveying blade 112*a* is sampled for a fixed period, immediately after toner discharger drive motor 126 starts operating, as shown in FIG. 10. In this case, if first conveying member 112 stops during this sampling, it is impossible to calculate the ΔTCS value correctly.

T3 in FIG. 10 indicates the permitted time of a toner supply operation, and specifies the duration from time Ta3 when a command of toner supply to developing device 2 is given from toner concentration controller 130 to toner supply device 22 or when toner discharger drive motor 126 starts operating to time T3*c* when it is determined by sheet conveyance detecting sensor 38 that the last sheet has passed therethrough.

For example, when agitation of the developer is stopped at time T3*b* immediately after a toner supply as shown in FIG. 10, the minimum value A of the toner concentration cannot be detected. On the other hand, when agitation of the developer is stopped at time T3*c* at which a predetermined period of time has passed from the start of a toner supply, the correct minimum value A of toner concentration can be detected.

Next, the processing steps of toner supply will be described in detail based on flow charts.

Figure 12:
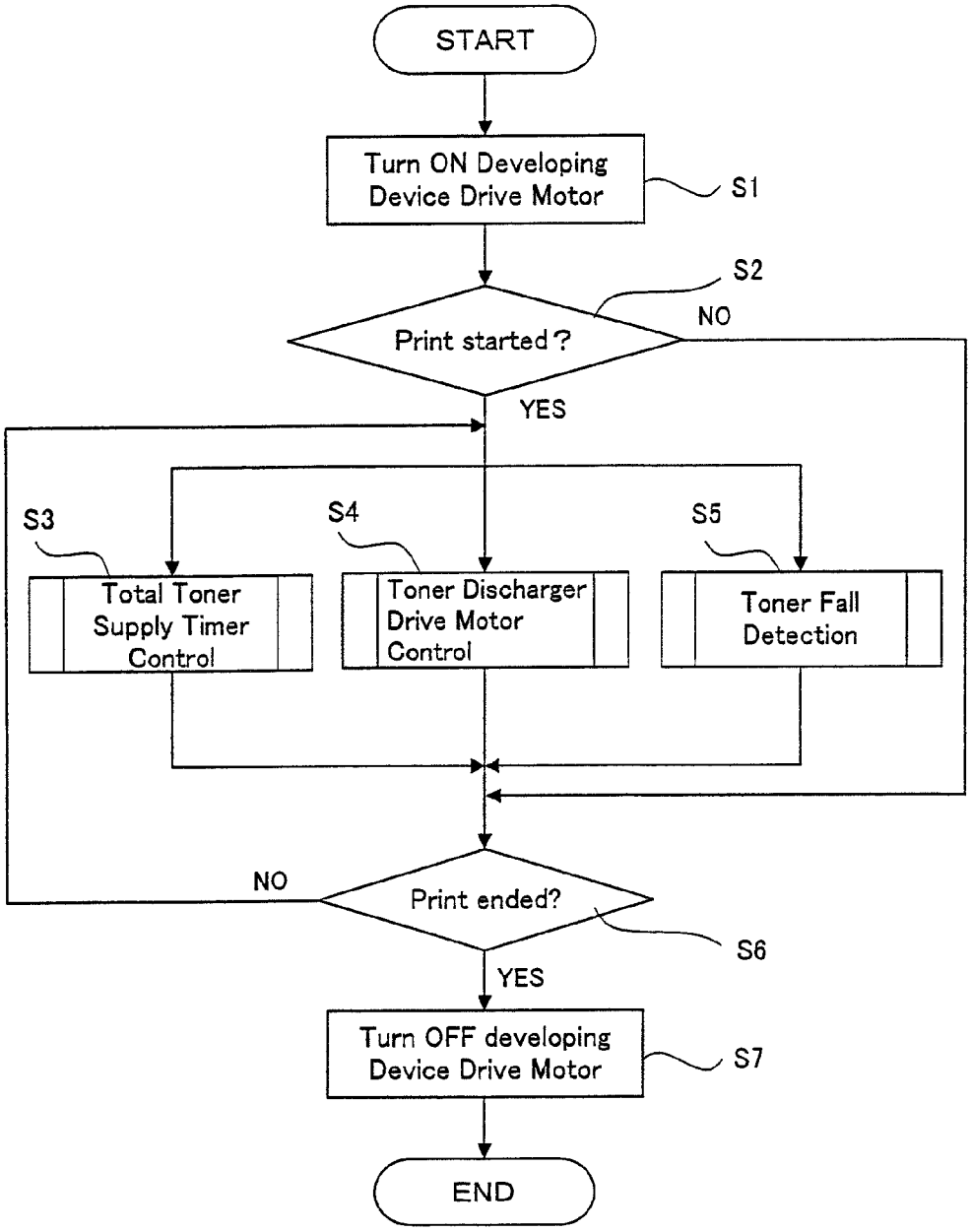
FIG. 12 is a flow chart showing the overall processing steps of toner supply in the image forming apparatus.
Figure 13:
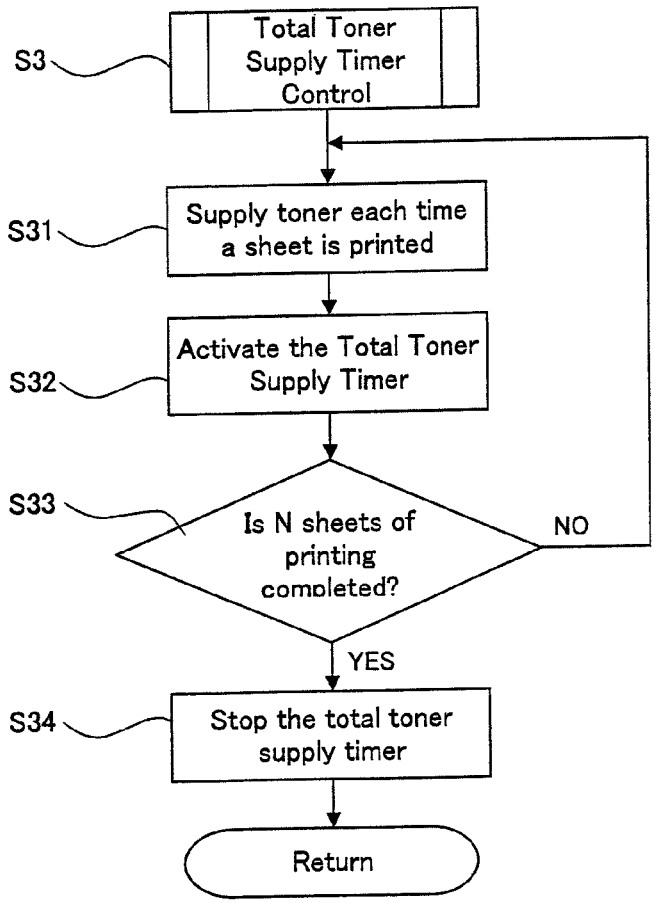
FIG. 13 is a flow chart showing toner supply control in the image forming apparatus.
Figure 14:
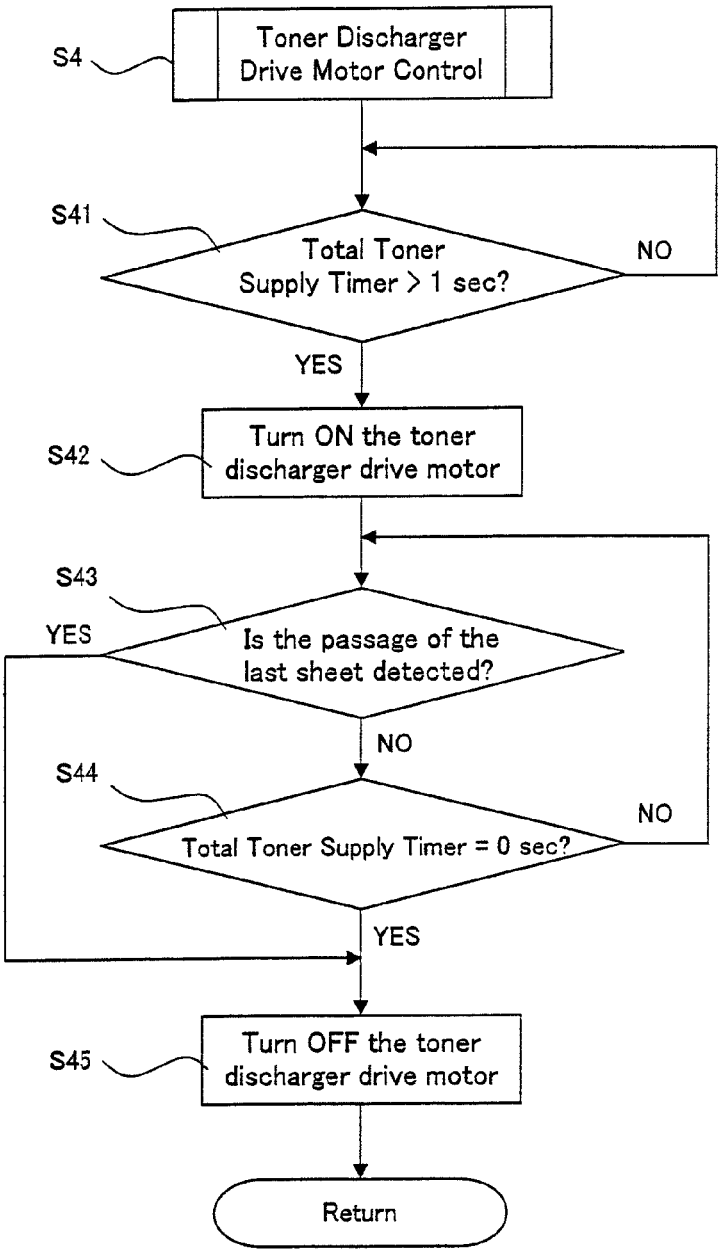
FIG. 14 is a flow chart showing toner discharger drive motor control in the image forming apparatus; and, FIG. 15 is a flow chart showing control of toner fall into a developing device in the image forming apparatus.
Figure 15:
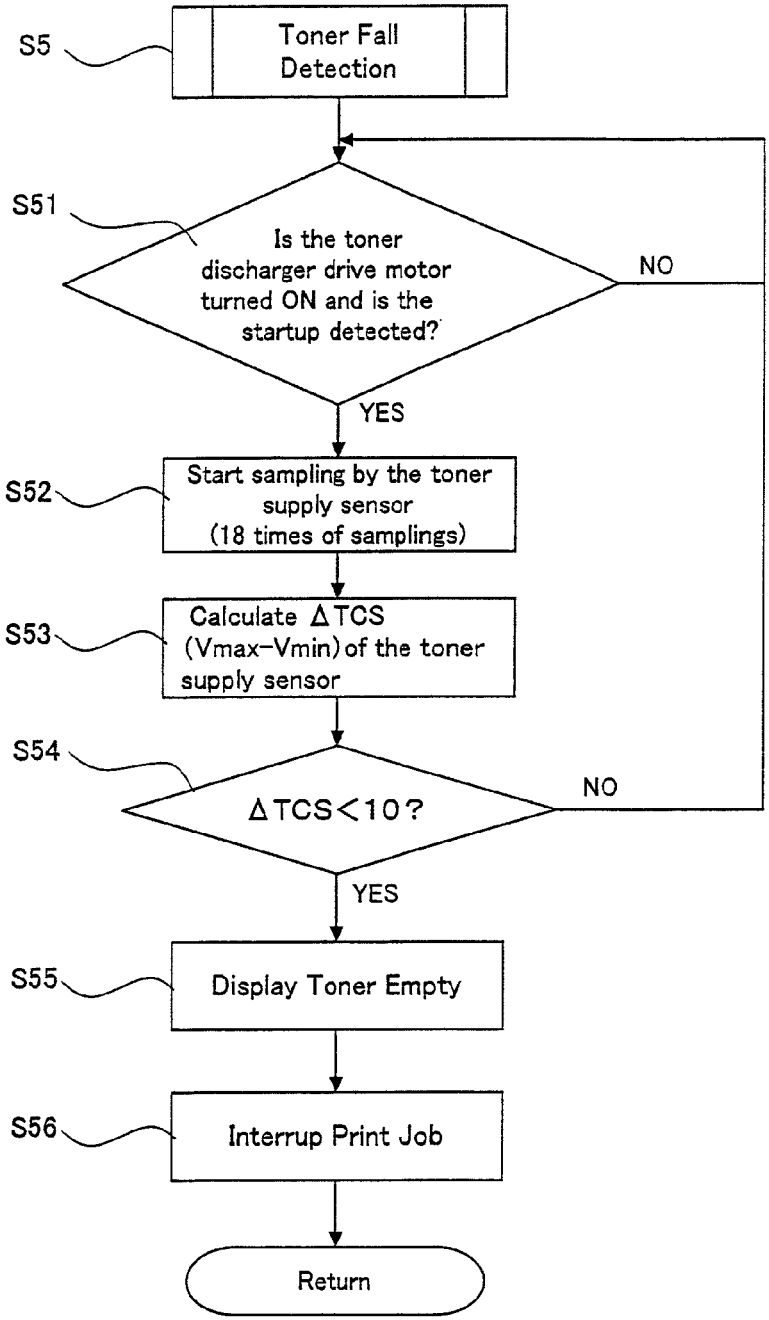

FIG. 12 is a flow chart showing the overall processing steps of toner supply in image forming apparatus 100 of the present exemplary embodiment. FIG. 13 is a flow chart showing toner supply control in the image forming apparatus 100. FIG. 14 is a flow chart showing toner discharger drive motor control in the image forming apparatus 100. FIG. 15 is a flow chart showing control of toner fall into the developing device in the image forming apparatus 100.

As shown in FIG. 12, when image forming apparatus 100 starts operating, the drive motor of developing device 2 drives (Step S1), and it is determined whether a printing operation is to be started (Step S2).

At Step S2, if it is determined that a printing operation starts, total toner supply timer control is performed (Step S3), toner discharger drive motor control is performed (Step S4) and toner fall detection is performed (Step S5). Then, it is determined whether the printing operation is ended (Step S6). The total toner supply timer control (Step S3), toner discharger drive motor control (Step S4) and toner fall detection (Step S5) will be detailed later.

On the other hand, if it is determined at Step S2 that no printing operation starts, the control goes to Step S6, where it is determined whether printing is ended.

When it is determined at Step S6 that printing is ended, the drive motor of developing device 2 is turned off (Step S7) so as to end the operation.

Next, total toner supply timer control (Step S3) will be described in detail based on a flow chart.

As shown in FIG. 13, when total toner supply timer control is started in image forming apparatus 100 (Step S3), toner is supplied from toner supply device 22 to developing device 2 each time a sheet of paper is printed (Step S31), total toner supply timer is activated (Step S32), and it is determined whether N sheets of printing have been completed (Step S33).

When it is determined at Step S33 that N sheets of printing is completed, the total toner supply timer is stopped (Step S34).

When it is determined at Step S33 that N sheets of printing have not been completed, the control returns to Step S31, and the same loop is repeated until N sheets of printing are completed.

Thus, total toner supply timer control in image forming apparatus 100 is implemented.

Next, toner discharger drive motor control (Step S4) will be described in detail with reference to a flow chart.

The toner discharger drive motor control at Step S4 is implemented by toner supply device control function 131 and toner supply stopping function 132 in toner concentration controller 130 (FIG. 8).

As shown in FIG. 14, when toner discharger drive motor control is implemented in image forming apparatus 100 (Step S4), it is determined whether total toner supply timer exceeds 1 second (Step S41).

If it is determined at Step S41 that the tonal toner supply timer exceeds 1 second, toner discharger drive motor 126 (FIG. 8) is turned on (Step S42), and it is determined whether sheet conveyance detecting sensor 38 (FIGS. 1 and 8) has detected the last paper (the last sheet) in the job being executed, having passed through sheet conveyor system S (Step S43).

On the other hand, when is determined that the total toner supply timer has not exceeded 1 second, the loop is repeated until the total toner supply timer exceeds 1 second.

When it is determined at Step S43 that sheet conveyance detecting sensor 38 has detected the last paper having passed through sheet conveyor system S, toner discharger drive motor 126 is stopped (Step S45).

The stoppage of toner discharger drive motor 126 at Step S45 is implemented by toner supply stopping function 132 in toner concentration controller 130 (FIG. 8).

On the other hand, when it is determined at Step S43 that sheet conveyance detecting sensor 38 has not detected the last paper having passed through sheet conveyor system S, it is determined whether the total toner supply timer is 0 second or not (Step S44).

When it is determined at Step S44 that total toner supply timer is 0 second, toner discharger drive motor 126 is stopped (Step S45).

On the other hand, when it is determined at Step S44 that the total toner supply timer is not 0 second, the control returns to Step S43.

This loop is repeated until sheet conveyance detecting sensor 38 detects the last paper having passed through sheet conveyor system S at Step S43 or until the total toner supply timer becomes 0 second at Step S44.

In this way, control of the toner discharger drive motor in image forming apparatus 100 can be executed.

Next, toner fall detection (Step S5) will be described in detail with reference to a flow chart.

As shown in FIG. 15, when toner fall detection is performed in image forming apparatus 100 (Step S5), it is determined whether the startup of toner discharger drive motor 126 (FIG. 8) to be driven has been detected (Step S51).

When the startup of toner discharger drive motor 126 is detected at Step S51, sampling by toner supply detecting sensor 119 (FIGS. 4 and 8) is started (Step S52). In the present embodiment, toner supply detecting sensor 119 performs 18 times of samplings.

Then, output difference ΔTCS (FIG. 10) is calculated based on the sensor output from toner supply detecting sensor 119 (Step S53), and it is determined whether ΔTCS of the sensor output from toner supply detecting sensor 119 is smaller than 10, for example (Step S54).

When it is determined at Step S54 that ΔTCS of the sensor output from toner supply detecting sensor 119 is smaller than 10, a toner empty indication is displayed on a control screen (LCD panel) or the like by toner empty detecting means 140 (Step S55), and the printing job is interrupted (Step S56).

On the other hand, when it is not determined at Step S54 that ΔTCS of the sensor output from toner supply detecting sensor 119 is smaller than 10, the control returns to Step S51.

Thus, toner fall detection in image forming apparatus 100 is implemented.

As described above, control of a toner supply operation of toner supply device 22 is performed in the permitted time T3 that is specified from time T3*a* at which toner supply from toner supply device 22 to developing device 2 is started, to time T3*c* at which sheet conveyance detecting sensor 38 located at a position in sheet conveyor system S determines that the last sheet in the job being executed has passed therethrough so as be able to obtain correct differences between the outputs from toner supply detecting sensor 119 before and after a toner supply operation, whereby it is possible to precisely determine the status of toner empty without erroneous detection.

Further, the risk of erroneous calculation of ΔTCS arising from stoppage of first conveying member 112 before the end of the printing job can be eliminated so as to contribute to exact detection of the timing of toner empty. As a result, it is possible to solve the problem of a large amount of toner remaining due to too early detection of toner empty and the problem of image quality degradation due to too late detection of toner empty.

The output from toner supply detecting sensor 119 is sampled for a fixed period of time in time with the toner supply operation by the aforementioned toner concentration controller 130, the ΔTCS or the ratio obtained from this sampling is used for determination of toner empty by comparison with toner empty decision threshold Ve (FIG. 11), it is hence possible to precisely detect the status of toner empty. As a result, it is possible to prevent occurrence of carrier adherence to photoreceptor drum 3 resulting from reduction in toner concentration.

Since toner supply detecting sensor 119 is disposed in the vicinity of toner supply port 115*a* of developing device 2 and on the bottom of first conveying passage P under toner supply port 115*a*, it is possible to promptly detect a change of the magnetic permeability of the developer when toner is supplied from toner supply device 22.

Accordingly, in a case where toner supply detecting sensor 119 has detected no change in magnetic permeability even when the toner concentration in the developer inside developing device 2 had become lower than the predetermined level and the toner concentration control means 130 directed toner supply device 22 to supply toner, it is possible for toner empty detector 140 to promptly conclude that the toner in toner supply device 22 is used up (toner empty). As a result, it is possible to prevent the occurrence of carrier adherence to photoreceptor drum 3 due to a reduction in toner concentration when a toner image is formed on photoreceptor drum 3.

Further, according to the present embodiment, since first conveying member 112 is constructed so that the inclined angle θ of the helical blade falls within the range from 30 degrees to 60 degrees, the force of agitating the developer in the rotational direction of first conveying member 112 becomes strong so that the so-called "floating toner", the added toner being conveyed floating over the developer, becomes unlikely to occur. Accordingly, it is possible for toner supply detecting sensor 119 to detect change in magnetic permeability of the developer with precision even after toner supply is carried out.

The above embodiment was described taking an example in which the image forming apparatus of the present invention is applied to image forming apparatus 100 shown in FIG. 1. However, as long as it is an image forming apparatus in which the toner concentration of the developer in the developing device is controlled by supplying toner from a toner supply device, the invention can be developed to any other image forming apparatus and the like, not limited to the image forming apparatus and copier having the configuration described above.

Having described heretofore, the present invention is not limited to the above embodiment, various changes can be made within the scope of the appended claims. That is, any embodied mode obtained by combination of technical means modified as appropriate without departing from the spirit and scope of the present invention should be included in the technical art of the present invention.

What is claimed is:

1. An image forming apparatus comprising:

a developing device;

a toner supply device that supplies toner to the developing device;

a toner supply detecting sensor that detects the toner supply to the developing device;

a toner concentration controller that directs the toner supply device to perform toner supply to the developing device when a toner concentration of a developer in the developing device becomes lower than a predetermined level;

a toner empty determiner for determining that no toner is left in the toner supply device when the toner supply detecting sensor does not detect the effect of toner supply after the direction of the toner supply from the toner concentration controller; and, a sheet conveyance detecting sensor for detecting the paper that passes by a predetermined position in a paper conveyance path through which paper is conveyed, wherein the developing device comprises:

a developer container for storing a developer including the toner and a magnetic carrier;

a developer conveying structure disposed inside the developer container for agitating and circulatively conveying the developer;

a developing roller for supplying the toner contained in the developer to a photoreceptor drum; and, a toner supply port that leads the supplied toner into the developer container, and, the toner concentration controller controls the operation of the toner supply device during a toner supply operation-permitted period, and when the sheet conveyance detecting sensor detects that a last sheet of an image printing being executed has passed by the predetermined position in the sheet conveyance path, the toner concentration controller controls the toner supply device so as to stop the toner supply to the developing device, and, the toner empty determiner, when an average value of the output from the toner supply detecting sensor over one cycle of a helical blade of the developer conveying structure is sampled for a fixed period of time immediately after the start of the supplying operation of the toner supply device, calculates a difference between a maximum value and a minimum value, during the toner supply operation-permitted period, and the toner empty determiner interrupts a printing job based on the difference between the maximum value and the minimum value, and the toner supply operation-permitted period is specified as the duration from a time when a command of toner supply to the developing device is given from the toner concentration controller to the toner supply device, to a time when it is determined by the sheet conveyance detecting sensor that the last sheet has passed thereby.

2. The image forming apparatus according to claim 1, wherein the toner supply detecting sensor detects the magnetic permeability of the developer in the developer container.

3. The image forming apparatus according to claim 2, wherein the developer container includes a first conveying passage and a second conveying passage that are sectioned by a partitioning wall and arranged to communicate with each other at both ends of the partitioning wall, the developer conveying structure includes a first conveying member and a second conveying member that are arranged in the first convening passage and second conveying passage, respectively, agitate and circulatively convey the developer in the first conveying passage and in the second conveying passage, in opposite directions to each other, the developing roller supplies the developer inside the second conveying passage to the photoreceptor drum, the toner supply port is disposed over the first conveying passage, and, the toner supply detecting sensor is disposed at the bottom of the first conveying passage under the toner supply port.

4. The image forming apparatus according to claim 3, wherein the first conveying member is a screw auger having a rotary shaft and a helical blade, and the helical blade is formed so that the inclined angle relative to the axial direction of the rotary shaft is specified to fall within the range of 30 degrees to 60 degrees.

5. The image forming apparatus according to claim 1, further comprising:

a dot counter for counting dots of data corresponding to image data to be transmitted to an exposure device for forming an electrostatic latent image on the photoreceptor drum surface, wherein the toner concentration controller instructs the toner supply device to supply toner to the developing device based on the count of the dots of data from the dot counter.

6. An image forming method for an image forming apparatus comprising:

a developer conveying step of agitating and circulatively conveying a developer containing a toner and a magnetic carrier inside a developing device;

a developing step of supplying the toner from the developing device to a photoreceptor drum to develop an electrostatic latent image on the photoreceptor drum;

a toner supplying step of supplying toner from a toner supply device to the developing device;

a toner supply detecting step of detecting the toner supply into the developing device;

a toner concentration control step of directing the toner supply device to perform the toner supply to the developing device;

a toner empty detecting step of determining that the toner in the toner supply device is used up; and, a sheet conveyance detecting step of detecting the paper passing by a predetermined position in a paper conveyance path for conveying paper, wherein the toner concentration control step includes the steps of:

controlling the operation of the toner supply device during a toner supply operation-permitted period; and, when the sheet conveyance detecting step detects that a last sheet of an image printing being executed has passed by the predetermined position in the sheet conveyance path, controlling the toner supply device so as to stop the toner supply to the developing device, and, the toner empty detecting step includes the steps of:

calculating a difference between a maximum value and a minimum value, when an average value of the output from the toner supply detecting step over one cycle of a helical blade of a developer conveying structure is sampled for a fixed period of time immediately after the start of the supplying operation of the toner supply device, during the toner supply operation-permitted period; and, interrupting a printing job based on the difference between the maximum value and the minimum value, and the toner supply operation- permitted period is specified as the duration from a time when a command of toner supply to the developing device is given from the toner concentration controller to the toner supply device, to a time when it is determined by the sheet conveyance detecting sensor that the last sheet has passed thereby.

* * * * *